US011335306B2

(12) United States Patent
Rabe et al.

(10) Patent No.: US 11,335,306 B2
(45) Date of Patent: May 17, 2022

(54) PERCUSSION INSTRUMENT HAVING AT LEAST ONE TONE BAR

(71) Applicant: SONOR GmbH, Bad Berleburg (DE)

(72) Inventors: Philipp Rabe, Edertal-Wellen (DE); Knut Hoyer, Villingen-Schwenningen (DE); Ralph Christian Bremenkamp, Munich (DE)

(73) Assignee: SONOR GmbH, Bad Berleburg (DE)

( * ) Notice: Subject to any disclaimer, the term of this patent is extended or adjusted under 35 U.S.C. 154(b) by 0 days.

(21) Appl. No.: 17/019,496

(22) Filed: Sep. 14, 2020

(65) Prior Publication Data

US 2021/0082377 A1 Mar. 18, 2021

(30) Foreign Application Priority Data

Sep. 16, 2019 (DE) ..... 10 2019 124 903.1

(51) Int. Cl.
*G10D 13/08* (2020.01)
*G10D 13/24* (2020.01)

(52) U.S. Cl.
CPC ..... *G10D 13/08* (2013.01); *G10D 13/24* (2020.02)

(58) Field of Classification Search
CPC ..... G10D 13/08; G10D 13/24
See application file for complete search history.

(56) References Cited

U.S. PATENT DOCUMENTS 1,237,873 A * 8/1917 Deagan ..... G10D 13/08 84/403
1,291,778 A * 1/1919 Deagan ..... G10D 13/08 84/403
1,369,268 A * 2/1921 Deagan ..... G10D 13/08 84/410
1,484,655 A * 2/1924 Kohler ..... G10D 13/08 84/403
2,020,150 A * 11/1935 Ludwig ..... G10D 13/08 84/403
2,287,138 A * 6/1942 Sas ..... G10D 13/08 84/410
D158,632 S * 5/1950 Zimmerman ..... D17/23
2,704,482 A * 3/1955 Sas ..... G10D 13/08 84/403
2,799,198 A * 7/1957 Zimmerman ..... G10D 13/08 84/403
3,174,382 A * 3/1965 Gugelot ..... G10D 13/08 84/404
3,483,786 A * 12/1969 Heninger ..... G10D 13/08 84/470 R (Continued)

FOREIGN PATENT DOCUMENTS

DE 7346111 U 4/1974
DE 1803789 B2 6/1975

(Continued)

OTHER PUBLICATIONS

Co-prending U.S. Appl. No. 17/019,592.
Co-pending U.S. Appl. No. 17/247,631.

*Primary Examiner* — Robert W Horn
(74) *Attorney, Agent, or Firm* — Smartpat PLC

(57) ABSTRACT

A percussion instrument has at least one tone bar, retaining elements for fastening the tone bar, and at least one resonance body with upper and lower sides.

18 Claims, 4 Drawing Sheets

(56) References Cited

U.S. PATENT DOCUMENTS

| | | | | | |
|---|---|---|---|---|---|
| 3,705,527 | A * | 12/1972 | Burnham | G10D 13/08 84/403 |
| 3,858,477 | A * | 1/1975 | Kawakami | G10D 13/08 84/410 |
| 3,961,553 | A * | 6/1976 | Schorr | G10D 13/08 84/408 |
| D318,305 | S * | 7/1991 | Takahashi | D21/410 |
| 5,479,843 | A * | 1/1996 | Yanagisawa | G10D 13/08 248/187.1 |
| 5,686,679 | A | 11/1997 | Nakano et al. | |
| 6,696,628 | B2 * | 2/2004 | Yoshida | G10D 13/08 84/321 |
| D491,215 | S * | 6/2004 | Tanaka | D17/23 |
| 10,109,263 | B1 * | 10/2018 | Fugate | G10G 5/005 |
| D907,718 | S * | 1/2021 | Reese | A63H 33/22 D21/410 |
| 2021/0082377 | A1 * | 3/2021 | Rabe | G10D 13/08 |
| 2021/0082378 | A1 * | 3/2021 | Rabe | G10D 13/08 |

FOREIGN PATENT DOCUMENTS

| | | | | |
|---|---|---|---|---|
| DE | 9108858 | U1 | 10/1991 | |
| DE | 9116075 | U1 | 2/1992 | |
| DE | 19707358 | C2 | 2/2002 | |
| DE | 10357326 | A1 * | 6/2005 | G10D 13/08 |
| DE | 202005017628 | U1 | 6/2006 | |
| DE | 102005015812 | B3 * | 7/2006 | G10D 13/08 |
| DE | 102013101694 | | 6/2014 | |
| EP | 1872091 | A1 | 1/2008 | |
| EP | 2770497 | A2 * | 8/2014 | G10D 13/08 |
| GB | 2564438 | A | 1/2019 | |
| NL | 7605085 | A | 11/1977 | |

* cited by examiner

PERCUSSION INSTRUMENT HAVING AT LEAST ONE TONE BAR

TECHNICAL FIELD

The disclosure relates to a percussion instrument having at least one tone bar.

BACKGROUND

Percussion instruments with one or more tone bars are known from DE 7 346 111 U1, NL 76 05 085 or EP 1 872 091 B1. Depending on a pitch and an associated specific frequency band of the tone bar, a resonance body and a resonance chamber arranged in relation to the tone bar should have a design optimized for the specific frequency band to ensure the ideal sound characteristics of the percussion instrument.

With known designs, this leads to large dimensions of the percussion instruments, in particular for low tones of the tone bars and/or for percussion instruments with multiple tone bars. This can be particularly disadvantageous when the percussion instrument is transported or when multiple percussion instruments are stored in, for example, a school, where storage space is typically limited.

Due to the one-piece structure of a percussion instrument (that is, the resonance body simultaneously forms a cover plate, support structure and a frame for the resonance chamber(s)), compromises have to be made with regard to sound characteristics. The resonance chamber can no longer be ideally adapted to the different specific frequency bands of the tone bars. In addition, production-related parameters, such as material, manufacturing costs and times, influence the design of the resonance body. An optimization of the sound characteristics usually has a negative influence on the manufacturing parameters.

SUMMARY

Therefore, the object of the disclosure is to provide a percussion instrument with a compact design and optimum sound characteristics at the same or better manufacturing parameters.

The object is solved by a percussion instrument as claimed. A resonance chamber in a resonance body is bounded on its side facing a tone bar by a cover plate provided with at least one sound hole. The tone bar is fastened to the cover plate by a retaining element. The tone bar is not directly attached to the resonance body or the housing of the percussion instrument by a retaining element. Rather, the tone bar is attached to the cover plate by the retaining element. As a result, the design of the cover plate can have a positive influence on sound transmission between the tone bar and the resonance chamber. When designing the cover plate, special attention must be paid to the natural vibration behavior of the cover plate. Thereby, in order to optimize the sound characteristics, the material and/or material thickness of the cover plate and/or the resonance chamber must be adapted.

The cover plate is connected to the upper side of the resonance body in a positive-locking manner. This secures the cover plate against slipping during transport or playing. The positive-locking fit can be achieved, for example, by inserting the cover plate into a recess of the resonance body or a pin connection. This securing against displacement of the cover plate can also be achieved by multiple projections on the cover plate that surround the resonance body.

This design also enables more freedom in regard to the shape of the resonance body, and thus the sound and size can be optimized and a necessary tight closure of the resonance chamber by the cover plate can be achieved. This has a positive effect on the sound characteristics.

Furthermore, it is advantageous to provide at least one sound hole with a defined size in the cover plate, adapted to the tone bar. This allows the vibration transfer between the tone bar and the associated resonance chamber to be optimized in terms of vibration damping/amplification and resonance frequencies of the vibrations. Other advantageous designs of the percussion instrument are described in the dependent claims.

The cover plate may advantageously be connected to the upper side of the resonance body in a firmly bonded manner. This can take place, for example, by gluing or two-stage injection molding.

The resonance body, the resonance chamber and/or the cover plate may have reinforcements and/or weakened areas in their structure. This allows the resonance body and/or the resonance chamber to be shaped and made smaller without any negative influence on the sound characteristics.

It is advantageous to strengthen the resonance body, the resonance chamber, and/or the cover plate by changing the thickness of the material and/or by attaching additional components. This can be easily achieved in a production process of the percussion instrument without a significant increase in material requirements.

If the resonance body, the resonance chamber, and/or the cover plate are optimized with regard to the sound characteristics, it may occur that the resonance body no longer has sufficient bearing capacity. In such a case, it is advantageous if the resonance body is connected to a support structure that absorbs the forces during transport, storage and playing. In addition, the support structure allows a preferred outer shape of the percussion instrument to be formed without affecting the tonal characteristics of the percussion instrument.

Furthermore, it is an advantage if, in the case of two or more resonance chambers of a percussion instrument, the respective openings are bounded by a continuous cover plate opposite the tone bars. This simplifies the production of the percussion instrument. In the case of special demands on the sound characteristics, for example, for studio or concert instruments, it can be advantageous to use multiple cover plates in one instrument. In particular, if, for example, whole-tone tone bars are exchanged for half-tone tone bars, this can be advantageous for the sound characteristics, because the specific frequency band of the tone bar is shifted.

It is also advantageous if the size and shape of the sound hole in the cover plate is adapted to the specific resonant frequency of the tone bar. This has an advantageous effect on the transmission of vibrations between the tone bar and the resonance chamber. In particular, as explained in dependent claim 8, it is advantageous if the sound hole in the cover plate has a smaller cross-sectional area than the cross-sectional area of the opening of the resonance chamber, preferably less than 75%, more preferably less than 50%.

The resonance body may have at least one storage space, which can preferably be closed with a lid. Ideally, the lid is designed as a foldable lid. This lockable storage space can then be used to accommodate replacement or half-tone tone bars, mallets, or the like. In doing so, a drawer facilitates accessibility and handling.

Furthermore, it is advantageous if the support structure has at least one fastening element. Ideally, this enables the percussion instrument to stand on a table, for example, without slipping. In addition, the percussion instrument can be fastened to a frame (for example, a rollable frame) using the fastening element.

At least one bracket may be attached to the fastening element and ideally the bracket can be folded in. This means that the installation height on, for example, a table, can be easily varied. Percussion instruments can be connected to each other by means of the bracket. This means that when using different percussion instruments with, for example, varying tone bars, they can be securely positioned in relation to each other. In addition, when storing multiple percussion instruments, it is advantageous if percussion instruments can be stacked on top of each other by means of the bracket. This reduces the space required for storage. This type of percussion instruments stacked on top of each other can also be transported securely.

Furthermore, it is an advantageous design if the resonance body comprises a plurality of modules, each comprising at least one resonance chamber, at least one associated cover plate and at least one associated tone bar, preferably exactly one resonance chamber with an associated cover plate and an associated tone bar. This simplifies the structure of new percussion instruments and reduces the manufacturing costs.

The following detailed description is merely exemplary in nature and is not intended to limit the invention or the application and uses of the invention. Furthermore, there is no intention to be bound by any theory presented in the preceding background or the following detailed description.

DETAILED DESCRIPTION

The invention is described in detail below with reference to the figures mentioned in the form of embodiments. In all figures, the same technical elements are marked with the same reference signs.

Figure 1:
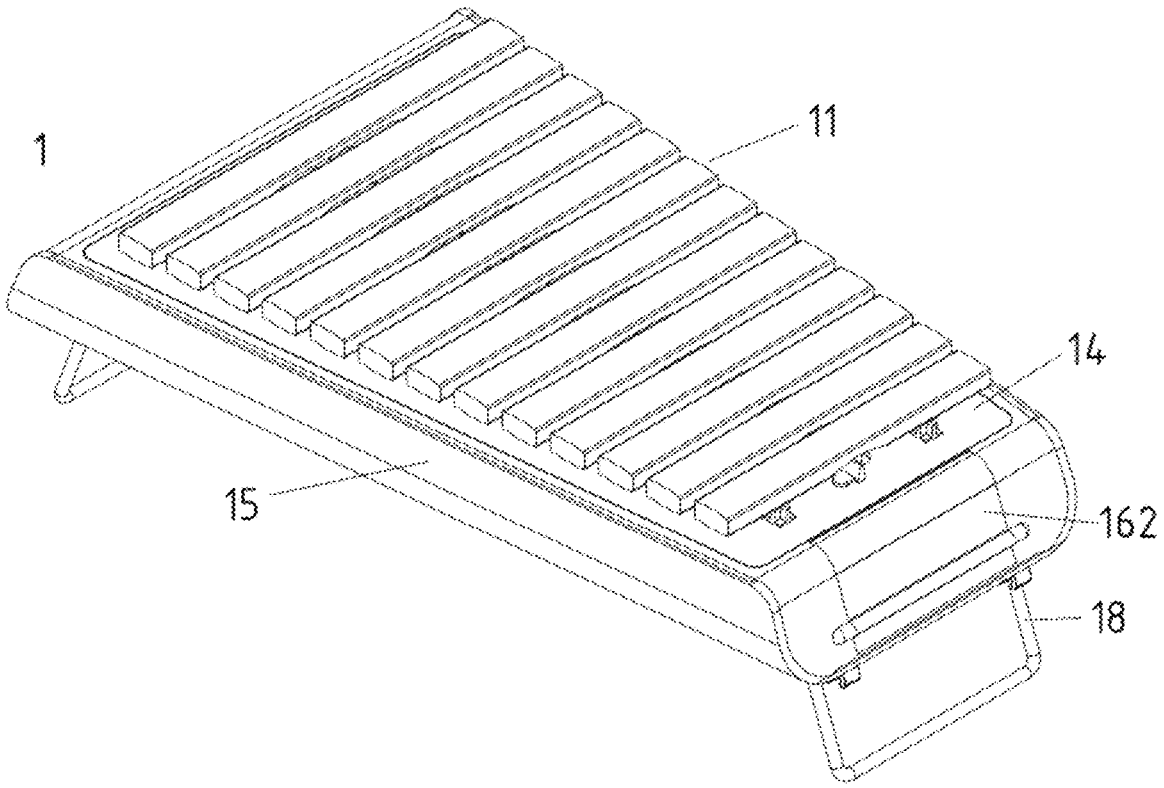
FIG. 1 shows an exemplary percussion instrument.

FIG. 1 shows an exemplary percussion instrument 1. This percussion instrument has 13 tone bars 11. A bracket 18 and a closed lid 162 are also shown.

Figure 2:
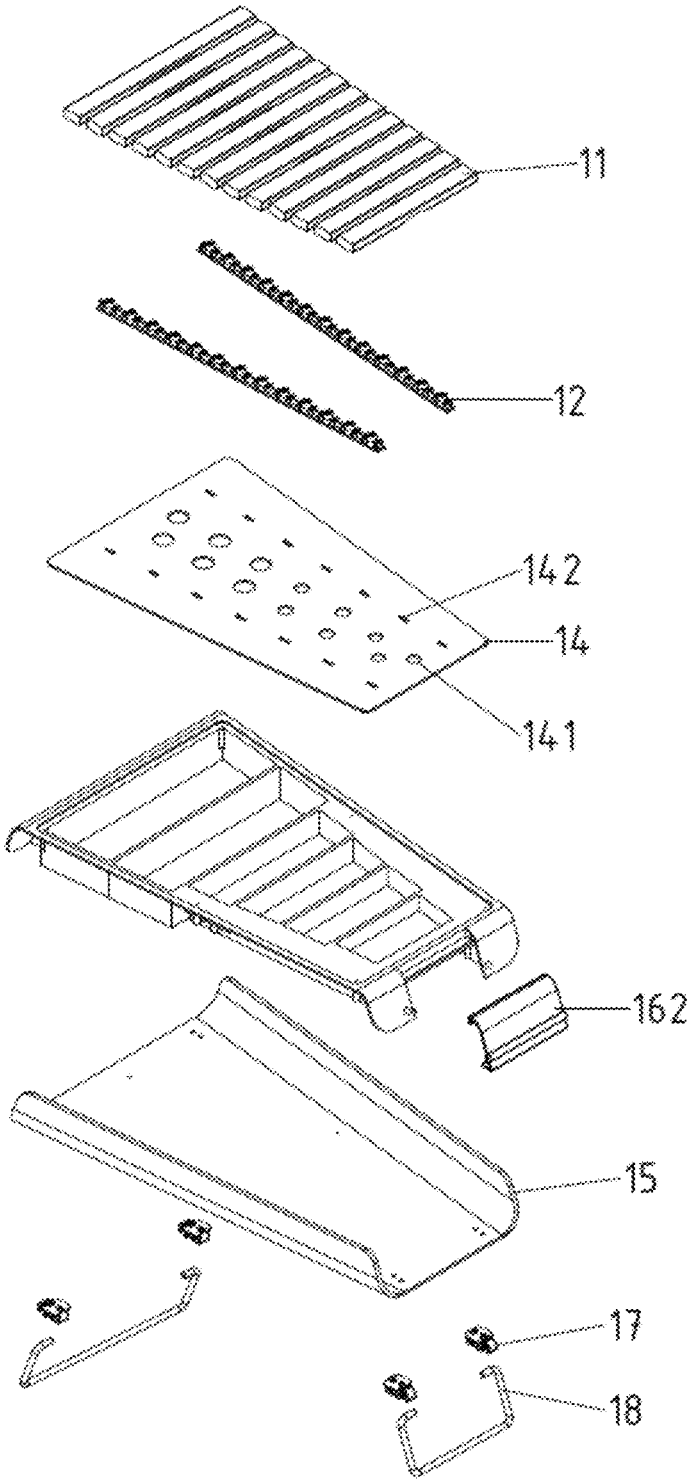
FIG. 2 shows a percussion instrument with the main components.

FIG. 2 shows the percussion instrument 1 of FIG. 1, disassembled into its main components. Between the tone bars 11 and the cover plate 14, there are two retaining elements 12, which connect the tone bars 11 with the cover plate 14. The cover plate 14 has sound holes 141 in the cover plate 14, which are arranged above the resonance chambers 131 belonging to the tone bars 11. Furthermore, fourteen mounting points 142 are arranged in two rows in the cover plate 14. At these mounting points 142, the retaining element 12 is fastened to the cover plate 14. The resonance chamber 13 with resonance chambers 131 and a lid 162 belonging to the resonance chamber 13 is below the cover plate 14. The resonance body 13 is shown in detail in FIG. 3. The resonance body 13 is located in a support structure 15 that encloses the resonance body 13 on three sides. On the lower side of the support structure 15, four fastening elements 17 are attached, wherein two fastening elements 17 hold one bracket 18 each.

Figure 3:
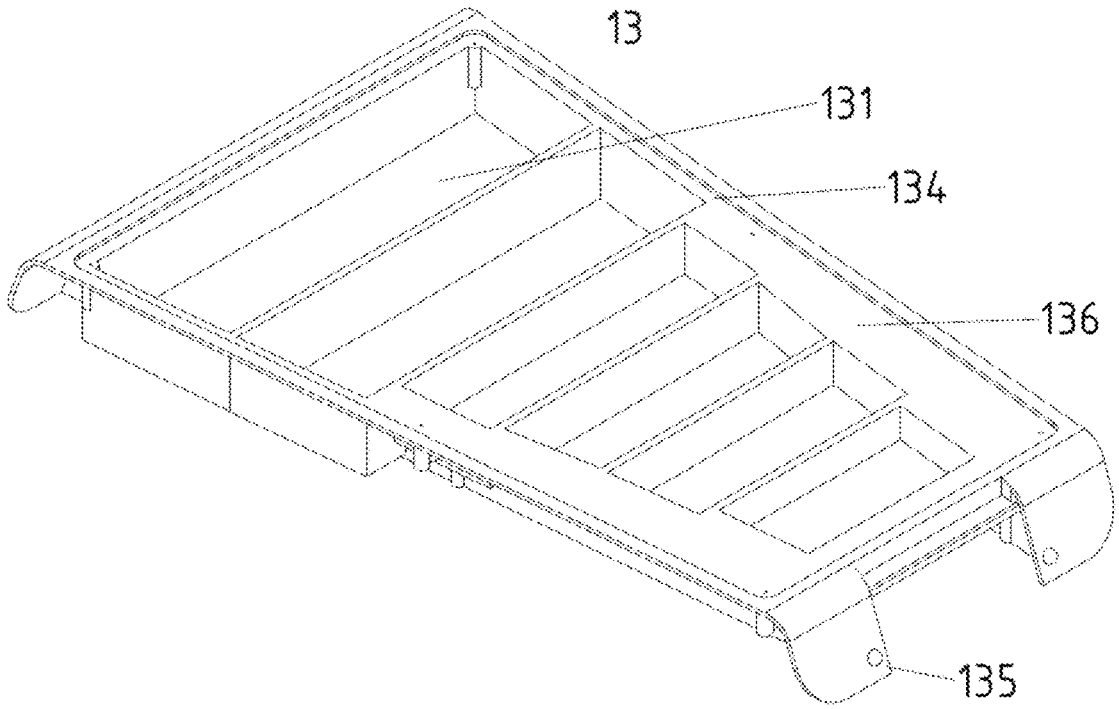
FIG. 3 shows a resonant body with multiple resonant chambers.

FIG. 3 shows the resonance body 13 with separate resonance chambers 131. The volume and position of the resonance chambers 131 are adapted to the tone bars 11. The resonance body 13 has a circumferential edge 134 on the upper side 136, which allows the cover plate 14 to be positioned relative to the resonance body 13 in a positive-locking manner.

Figure 4:
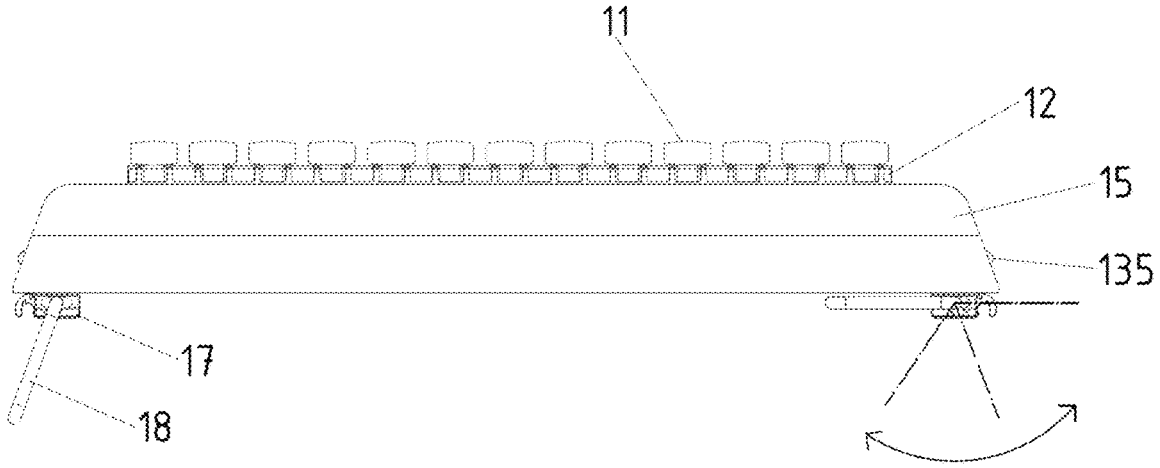
FIG. 4 is a side view of percussion instrument with foldable brackets.

FIG. 4 shows a side view of the percussion instrument 1, wherein two brackets 18 are attached to the support structure 15 by fastening elements 17. One bracket 18 is sketched in a folded-out position. In that position, the bracket 18 can be used as a stand. The second bracket 18 is shown in a folded-in position. As an example, possible angles with dashes are shown, with which the bracket 18 can snap into the fastening element 17. Folding the bracket 18 by 180° from its folded-in position enables a connection to an adjacent percussion instrument. In the folded-in position, the bracket 18 lies flat and does not project beyond the fastening elements 17. This means that the percussion instrument 1 can be placed on the fastening element 17 without the bracket 18 being in contact with an installation surface. Furthermore, it is possible, without dismantling the bracket 18, to fix the percussion instrument 1 on a frame with a bracket 18 in such position.

Figure 5:
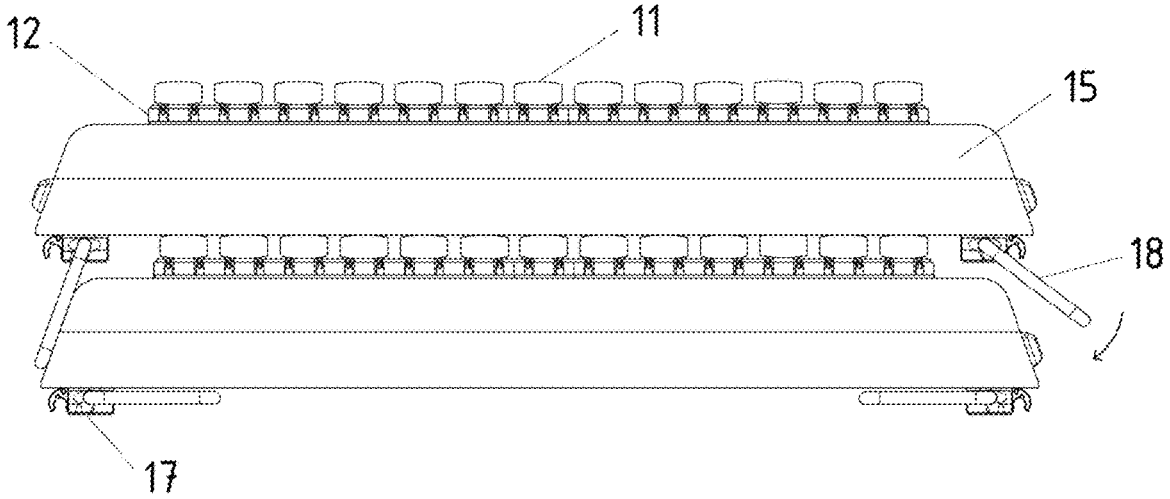
FIG. 5 is a side view of two stacked percussion instruments.

FIG. 5 shows two percussion instruments 1 stacked on top of each other. By means of a bracket 18, which can be fastened at a suitable angle, two or more percussion instruments 1 can be stacked on top of each other. Additional connection points 135 are attached to the outer side of the percussion instrument 1. The bracket 18 of the upper percussion instrument 1 can be fastened or snapped onto these.

REFERENCE NUMBERS

1 Percussion instrument
11 Tone bar
12 Retaining element
13 Resonance body
131 Resonance chamber
133 Opening
134 Circumferential edge
135 Connection point
136 Upper side
137 Lower side
14 Cover plate
141 Sound hole
142 Mounting point for retaining element
15 Support structure
16 Storage space
162 Lid
17 Fastening element
18 Bracket
19 Frame

What is claimed is:

1. A percussion instrument, comprising:

at least one tone bar;

retaining elements for fastening the at least one tone bar;

a resonance body with an upper side and a lower side made of plastic or another material which can be stamped, injection-molded or cast, the resonance body comprising at least one resonance chamber with an opening, the opening of the least one resonance chamber being directed towards the least one tone bar; and a cover plate with at least one sound hole which bounds the at least one resonance chamber on a side facing the at least tone bar, wherein the at least one tone bar is fastened to the cover plate by the retaining elements, and wherein the cover plate circumferentially abuts a circumferential edge of the resonance body and is thereby connected to the upper side of the resonance body in a positive-locking manner.

2. The percussion instrument according to claim 1, wherein the cover plate is permanently joint to the upper side of the resonance body.

3. The percussion instrument according to claim 1, wherein the resonance body, the resonance chamber and/or the cover plate has reinforcements and/or weakened areas of its structure.

4. The percussion instrument according to claim 3, wherein the resonance body, the resonance chamber and/or the cover plate is reinforced by changing a thickness of the plastic or the other material and/or by attaching one or more additional components.

5. The percussion instrument according to claim 1, wherein the resonance body is connected to a support structure.

6. The percussion instrument according to claim 1, wherein a size and a shape of the sound hole in the cover plate is adapted to a specific frequency band of the at least one tone bar.

7. The percussion instrument according to claim 1, wherein the sound hole in the cover plate has a smaller cross-sectional area than a cross-sectional area of the opening of the resonance chamber.

8. The percussion instrument according claim 1, wherein the resonance body comprises at least one storage space.

9. The percussion instrument according to claim 8, wherein the storage space comprises a drawer.

10. The percussion instrument according to claim 8, wherein the storage space is closed with a lid.

11. The percussion instrument according to claim 5, wherein at least one fastening element is attached to the support structure.

12. The percussion instrument according to claim 11, wherein the percussion instrument can be fastened to a frame by the fastening element.

13. The percussion instrument according to claim 11, wherein at least one bracket is attached to the fastening element.

14. The percussion instrument according to claim 13, wherein the bracket is foldable.

15. The percussion instrument according to claim 13, wherein the bracket is generally U-shaped, comprising two parallel legs having upper ends pivotally supported by the fasting elements and lower ends connected to one another by a lower bracket bar, wherein the percussion instrument comprises an outwardly protruding connection point, and wherein the percussion instruments can be connected to an identical percussion instrument by the bracket in that the lower bracket bar snaps onto the outwardly protruding connection point of the identical percussion instrument.

16. The percussion instrument according to claim 13, wherein the percussion instrument can be stacked on top of like percussion instruments by the bracket.

17. The percussion instrument according to claim 1, wherein the resonance body comprises a plurality of compartments, each comprising at least one resonance chamber, at least one associated cover plate and at least one associated tone bar.

18. A percussion instrument, comprising:

a plurality a tone bars;

retaining elements for fastening the tone bars;

a resonance body with an upper side and a lower side made of plastic or another material which can be stamped, injection-molded or cast, the resonance body comprising a plurality of resonance chambers, each of the plurality of resonance chambers having an opening being directed towards an associated on of the plurality of tone bars; and a cover plate which bounds the resonance chambers on a side facing the tone bars, the cover plate having a plurality of sound holes, wherein the tone bars are fastened to the cover plate by the retaining elements, and wherein the cover plate circumferentially abuts a circumferential edge of the resonance body and is thereby connected to the upper side of the resonance body in a positive-locking manner.

* * * * *